US005988622A

United States Patent [19]

Shigeta

[11] Patent Number: 5,988,622

[45] Date of Patent: Nov. 23, 1999

[54] PAPER FEEDING DEVICE

[75] Inventor: Kunihiro Shigeta, Ebina, Japan

[73] Assignee: Fuji Xerox Co., Ltd., Tokyo, Japan

[21] Appl. No.: 08/968,560

[22] Filed: Nov. 12, 1997

[30] Foreign Application Priority Data

Nov. 15, 1996 [JP] Japan ..... 8-304351
Oct. 21, 1997 [JP] Japan ..... 9-288096

[51] Int. Cl.[6] ..... B65H 3/44

[52] U.S. Cl. ..... 271/9.01; 271/9.12; 271/9.13

[58] Field of Search ..... 271/9.01, 9.12, 271/9.13

[56] References Cited

U.S. PATENT DOCUMENTS 5,307,116 4/1994 Ikanumi et al. ..... 355/207
5,405,128 4/1995 Fujiwara et al. ..... 271/9
5,570,172 10/1996 Acquiviva ..... 355/323
5,624,108 4/1997 Kubo ..... 271/9.12

FOREIGN PATENT DOCUMENTS 405097262 4/1993 Japan ..... 271/9.12
6-100190 4/1994 Japan .
6-236085 8/1994 Japan .
7-121084 5/1995 Japan .

*Primary Examiner*—William E. Terrell
*Assistant Examiner*—Kenneth W. Bower
*Attorney, Agent, or Firm*—Oliff & Berridge, PLC

[57] ABSTRACT

A paper feeding device includes a plurality of horizontally juxtaposed paper cassettes for containing papers. The feeding device includes a plurality of paper feeding mechanisms respectively corresponding to the paper cassettes, and each of the paper feeding mechanisms includes a separation/feeding unit for feeding papers from the paper cassette in a feeding direction. The separation/feeding unit corresponding to an upstream paper cassette of the upstream side is arranged at least partially above a paper receiving section of a downstream paper cassette to conserve space.

6 Claims, 5 Drawing Sheets

PAPER FEEDING DEVICE

BACKGROUND OF THE INVENTION

1. Field of the Invention

The present invention relates to a paper feeding device for supplying papers to an image forming apparatus, e.g., a copying machine, printer, facsimile machine and the like.

2. Description of the Related Art

Generally, a paper feeding device is installed into the image forming apparatus for supplying papers to an image forming section of the apparatus.

Recently, there are proposals of paper feeding devices uniquely designed for the purposes of space saving and supplying a large number of papers of small size, e.g., A4 size or letter size, which are more frequently used, as disclosed in Japanese Patent Unexamined Publication Nos. Hei. 6-236085 and 7-121084. In those paper feeding devices, paper cassettes containing papers of small size are juxtaposed while being substantially horizontally aligned.

An example of this type of the paper feeding device is shown in FIG. 5. As shown, paper cassettes 20*a* and 20*b*, disposed side by side, are provided with paper feeding mechanisms 21*a* and 21*b*, respectively. The paper feeding mechanism 21*a* (21*b*) picks up papers sheet by sheet from the associated paper cassette 20*a* (20*b*), and feeds them to its associated paper transport path 22 and then to an image forming section, which is located in the upper portion of the image forming apparatus.

Pull-out rails 23 are provided on both sides of the paper cassette 20*a* (20*b*), and enables the front loading (pulling out of the paper cassette to the front side of the apparatus) for supplying papers.

The paper feeding mechanism 21*a* (21*b*) associated with the paper cassette 20*a* (20*b*), as shown in FIG. 6, includes a pick-up roller 31, a feed roller 32 and a retarding roller 33.

The pick-up roller 31 is turned in the direction of an arrow B while being in press-contact with the upper surface of a sheet of the uppermost paper P of a stack of papers stored in the paper cassette, to thereby pick up the paper P and feed it in a paper feeding direction (of an arrow A).

The feed roller 32 and the retarding roller 33 successively receive the papers that are let out by the pick-up roller 31 and feeds the papers sheet by sheet to the paper transport path 22. To this end, the feed roller 32 is turned in the paper feeding direction (of an arrow C) on the paper P. The retarding roller 33, located under the paper P are press-contacted with the feed roller 32, while receiving a rotary torque (as shown in an arrow D), opposite in direction to the rotary torque of the feed roller 32, or a stopping torque.

The axial center of the feed roller 32 and that of the retarding roller 33 lie on a perpendicular line in order to feed the paper P substantially horizontally.

In the above-mentioned paper feeding device, the paper cassettes 20*a* and 20*b* are juxtaposed at the equal heights, and provided with the paper feeding mechanisms 21*a* and 21*b*, respectively. The combination of the feed roller 32 and the retarding roller 33 of each paper feeding mechanism 21*a* (21*b*) is located in a further downstream side of the downstream end of the paper cassette 20*a* (20*b*) (when viewed in the paper feeding direction).

Therefore, a space in which the feed roller 32 and the retarding roller 33 are placed must be secured between the paper cassettes 20*a* and 20*b*. In other words, the paper cassettes 20*a* and 20*b* must be arranged so as to provide a given space enough to receive the feed/retarding roller combination. Thus, the space for securing the feed roller 32 and the retarding roller 33, that is, the space other than the space for securing the papers is present between the paper cassettes 20*a* and 20*b*. This space is superfluous, and brings about an adverse effect on the efforts of the space saving.

Another type of the paper feeding device is disclosed in Japanese Patent Unexamined Publication No. Hei. 6-100190. The paper feeding device is designed such that papers contained in the paper cassette located upstream (when viewed in the paper feeding direction) are fed through the downstream paper cassette. Therefore, there is capable of simplifying the paper feeding mechanism for the upstream paper cassette, and eliminated the necessity of the superfluous space. However, in this case, the independent paper supplying from those paper cassettes is impossible. Therefore, during the paper feeding to the image forming section, it is impossible to supply papers to either of the paper cassettes. To supply papers to the paper cassette, the paper supplying operation to the image forming section must be interrupted. This impairs the efficiency of the image forming processing in the image forming apparatus.

SUMMARY OF THE INVENTION

Accordingly, an object of the present invention is to provide a paper feeding device of the cassette juxtaposed type which achieves much space saving without reducing the number of papers contained in the paper cassette, and enables to independently supply papers from the paper cassettes.

To achieve the above object, there is provided a paper feeding device for feeding papers to an image forming unit in an image forming apparatus, the paper feeding device including: a plurality of paper cassettes for containing papers, the paper cassettes being substantially horizontally juxtaposed, a plurality of paper feeding mechanisms respectively corresponding to the paper cassettes, each of the paper feeding mechanisms including separation/feeding means for feeding papers from the paper cassette in a paper feeding direction which is substantially horizontal, the paper feeding direction defining downstream side and upstream side, the separation/feeding means protruded in the downstream side of the paper cassette, wherein, in the paper cassettes being adjacent to each other, the separation/feeding means corresponding to an upstream paper cassette of the upstream side are arranged above a downstream paper cassette of the downstream side.

In the thus constructed paper feeding device, the separation/feeding means of the paper feeding mechanism associated with the paper cassette located upstream when viewed in the paper feeding direction is disposed at a position higher than the paper cassette located downstream when viewed in the paper feeding direction. Therefore, if the paper cassettes are arranged such that the separation/feeding means of the upstream paper cassette overhangs the downward paper cassette, there is no need of providing a space for the separation/feeding means. If the paper feeding mechanisms are respectively associated with the paper cassettes, and the separation/feeding means of the paper feeding mechanisms are located to a further downstream side of the downstream ends of the paper cassettes, there is no need of forming a space for the separation/feeding means between the two juxtaposed paper cassettes.

BRIEF DESCRIPTION OF THE DRAWINGS

FIG. 3 is an explanatory diagram for explaining how to supply papers to the paper cassettes in the paper feeding device.

DETAILED DESCRIPTION OF THE PREFERRED EMBODIMENTS

Paper feeding devices constructed according to the present invention will be described with reference to the accompanying drawings.

Figure 1:
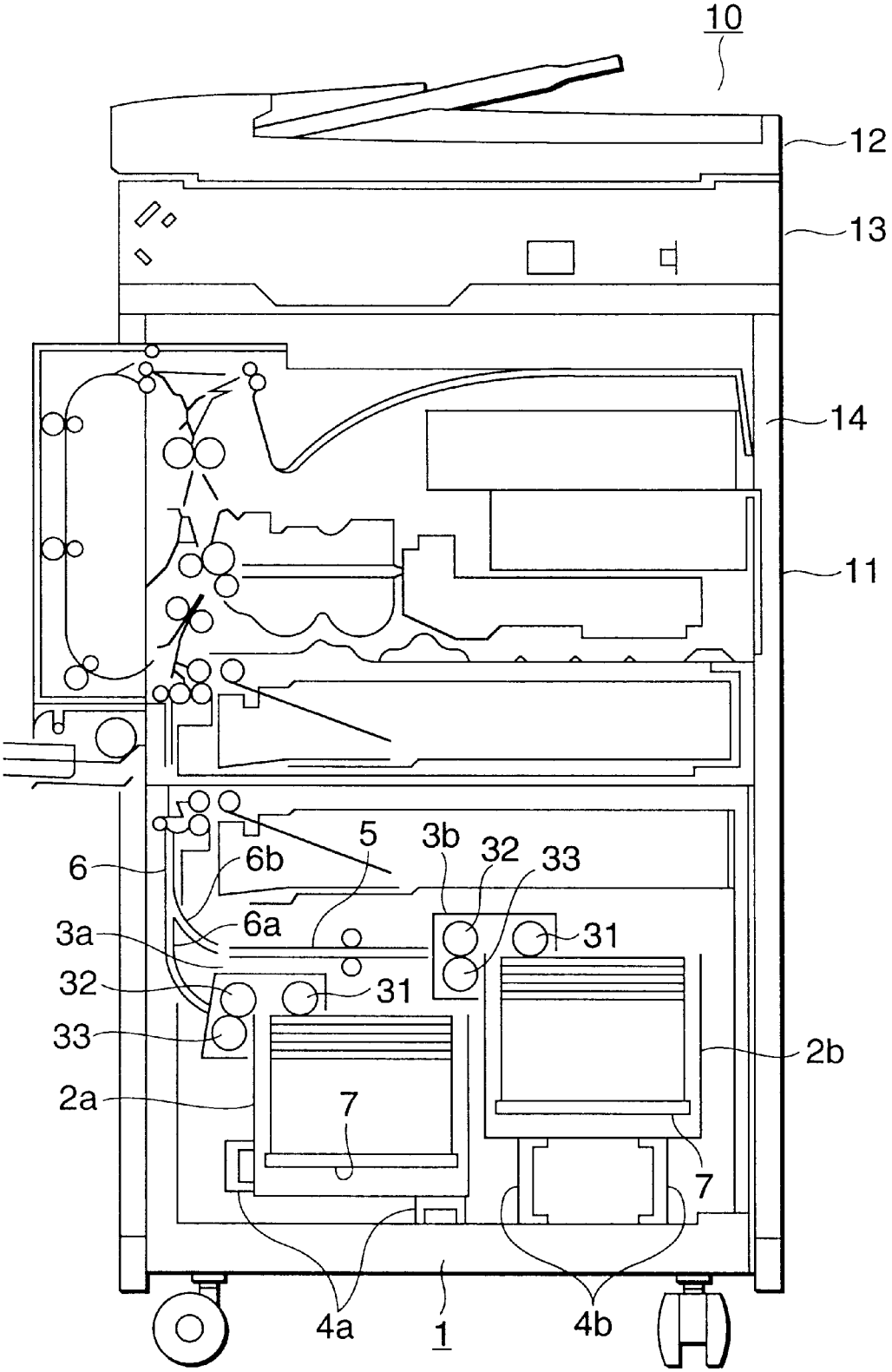
FIG. 1 is a diagram showing a paper feeding device which is an embodiment of the present invention, and an image forming apparatus (copying machine) incorporating the paper feeding device thereinto.

FIG. 1 is a diagram showing a paper feeding device 1 which is an embodiment of the present invention, and an image forming apparatus 10 (copying machine) incorporating the paper feeding device 1 thereinto.

The copying machine 10 incorporating thereinto the paper feeding device 1 which is an embodiment of the present invention will briefly be described.

The copying machine 10 is constructed by a copying machine main body 11 and an automatic paper feeder 12 covering the upper side of a machine body proper 11 with opening and closing of the upper side. The copying machine main body 11 houses an image reading unit 13 for reading out an image formed on an original document delivered from the automatic paper feeder 12 and transforming an image signal, an image forming unit 14 for forming a toner image on the paper in accordance with the image signal derived from the image reading unit 13, and a paper feeding device 1 for supplying papers to the image forming unit 14.

Figure 2:
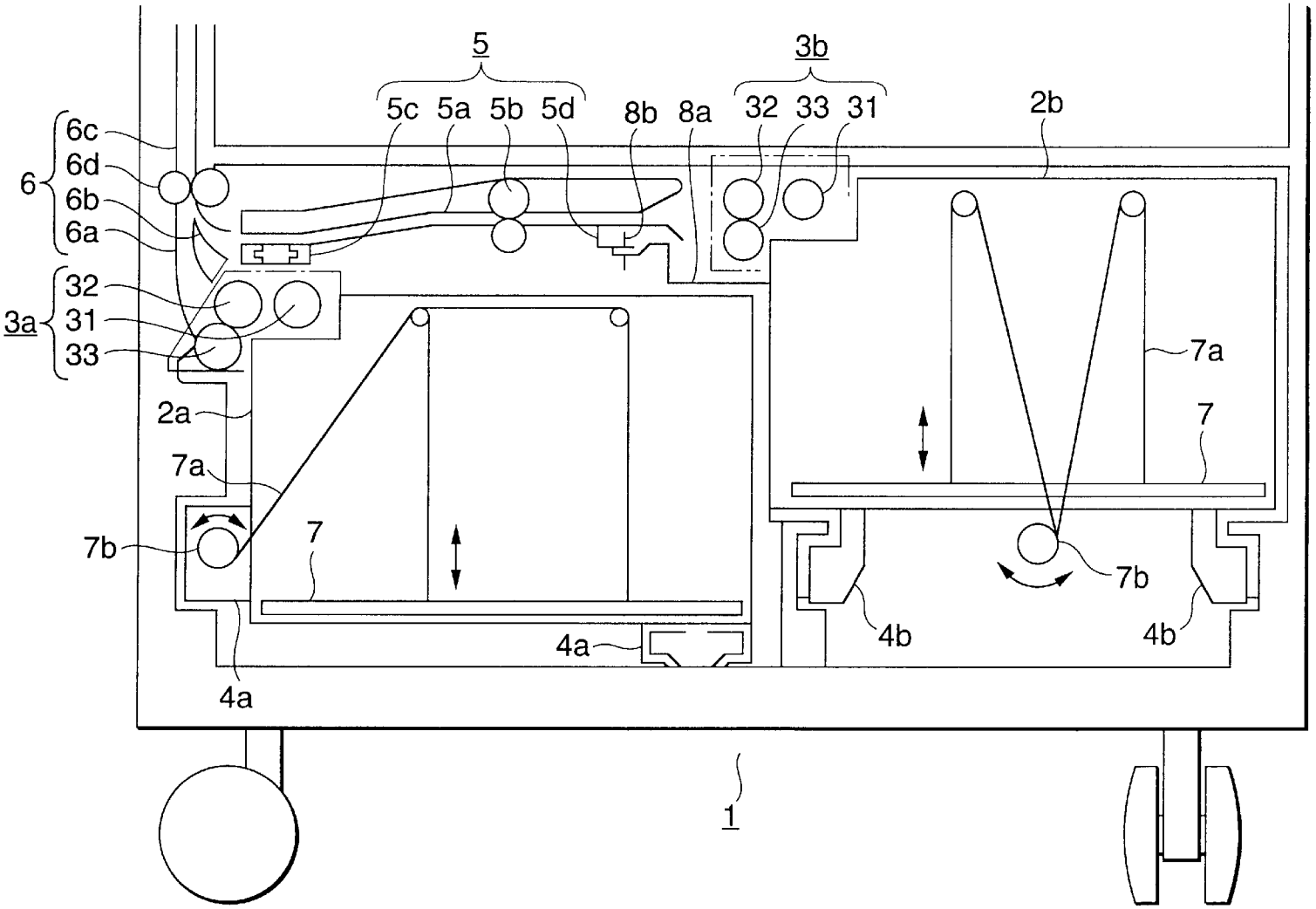
FIG. 2 is a diagram showing the details of the paper feeding device constructed according to the invention.

The paper feeding device 1 incorporated into the copying machine 10 will be described with reference to FIG. 2.

As shown, the paper feeding device 1 includes first and second paper cassettes 2*a* and 2*b*, first and second paper feeding mechanisms 3*a* and 3*b*, paired first and second pull-out rails 4*a* and 4*b*, a paper transport unit 5, and a paper transport path 6.

Those components of the paper feeding device will be described in detail.

The first and second paper cassettes 2*a* and 2*b* are arranged side by side in the paper feeding direction, with their attitudes being substantially horizontal. A great number of papers of small size (e.g., 1,500 sheets of papers) are stacked in each cassette.

A lifter 7, vertically movable, is provided within each paper cassette 2*a* (2*b*). The lifter 7 is used to secure papers in a stacked shape. The lifter 7 is coupled with a winding shaft 7*b* driven rotationally by a drive motor (not shown), through a wire 7*a*. When the winding shaft 7*b* is rotated, the lifter 7 is moved vertically. With provision of the lifter 7, the position (height) of the uppermost paper of the paper stack placed in the paper cassette 2*a* (2*b*) is maintained within a constant range of height.

The first and second paper cassettes 2*a* and 2*b* are designed to have equal paper containing capacities. In other words, component parts may be used common to the first and second paper cassettes 2*a* and 2*b* in constructing them. Those first and second paper cassettes 2*a* and 2*b* having the same capacity are steplike arranged when viewed from side. As shown, the second paper cassette 2*b* located upstream when viewed in the paper feeding direction (referred to simply as located upstream) is arranged higher than the first paper cassette 2*a* located downstream when viewed from side. Therefore, the paper supplying position (paper discharging position) of the second paper cassette 2*b* is higher than that of the first paper cassette 2*a*.

The steplike arrangement of the first and second paper cassettes 2*a* and 2*b* produces a space under the second paper cassette 2*b*. The winding shaft 7*b*, and the drive mechanism for driving the lifter 7 of the paper cassette 2*b* for its vertical movement are provided within this under space. The driving mechanism for the lifter 7 for the first paper cassette 2*a* is provided in a space present downstream of the paper cassette 2*a* (the space is located on the left side of the cassette 2*a* in FIG. 2).

Figure 6:
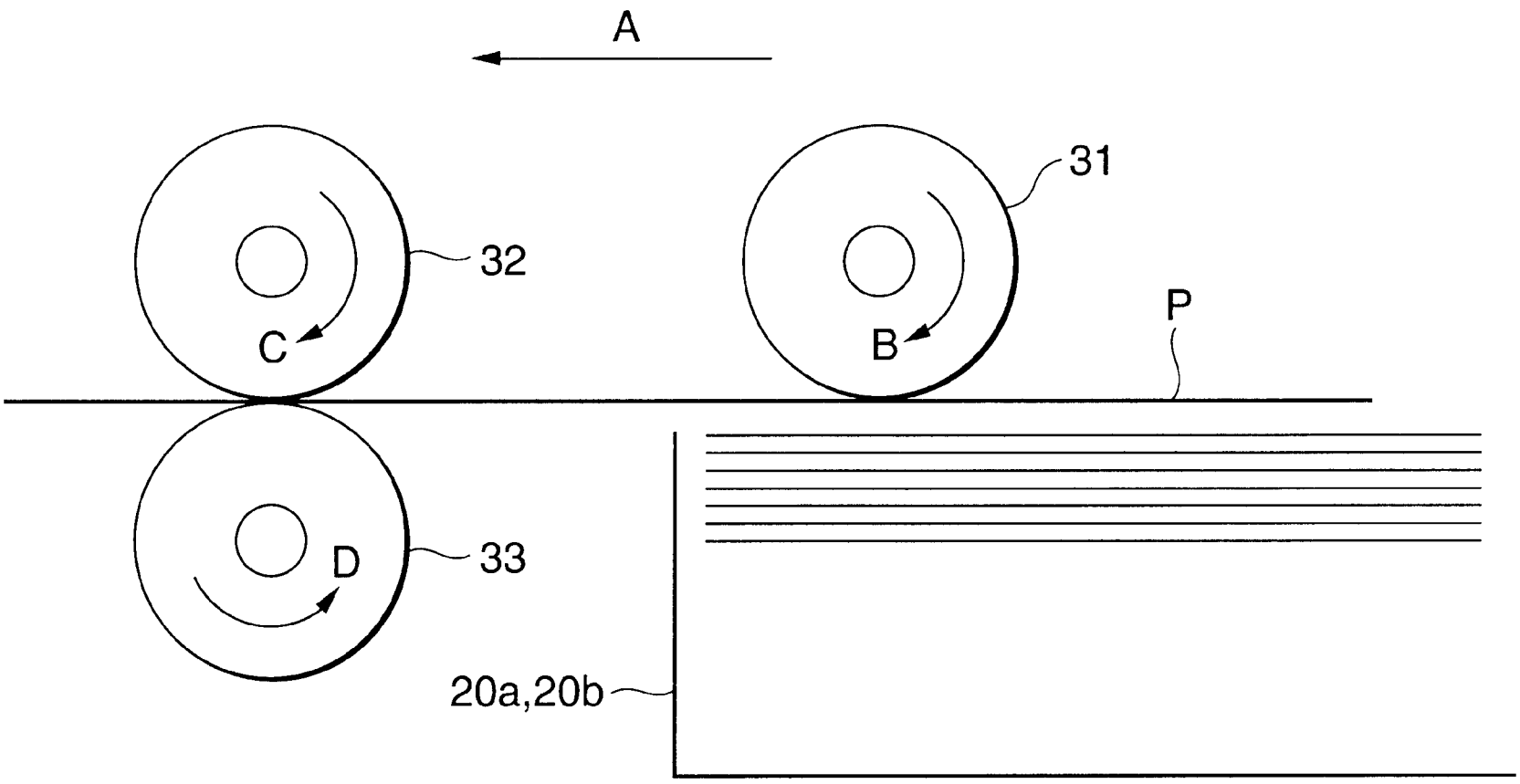
FIG. 6 is an explanatory diagram showing a paper supplying mechanism for supplying papers from paper cassettes to the image forming section.

First and second paper feeding mechanisms 3*a* and 3*b* are provided in association with the first and second paper cassettes 2*a* and 2*b*, respectively. Those paper feeding mechanisms picks up papers in a sheet-by-sheet fashion from the associated paper cassettes, and feed them in the same manner to the paper transport path 6 or the paper transport unit 5. Therefore, the paper feeding mechanism 3*a* (3*b*), as well as the conventional paper feeding device (FIG. 6), includes a pick-up roller 31, a feed roller 32 and a retarding roller 33 (separation/feeding means). The pick-up roller 31 feeds the uppermost paper P of the paper cassette in a paper feeding direction. The feed roller 32 and the retarding roller 33 feed forwardly the papers that are let out by the pick-up roller sheet by sheet.

Since the paper feeding position of the second paper cassette 2*b* is higher than that of the first paper cassette 2*a*, the feed and retarding rollers 32 and 33 of the second paper feeding mechanism 3*b* located upstream are positioned above the upper end of the first paper cassette 2*a*, that is, the feed and retarding rollers 32 and 33 of the second paper feeding mechanism 3*b* overhangs the upper end of the first paper cassette 2*a*. Thus, a horizontal plane between the feed roller 32 and the retarding roller 33 of the second paper feeding mechanism 3*b* overhangs a uppermost horizontal plane of the first paper cassette 2*a*.

In the first paper feeding mechanism 3*a* located downstream, the axial center of the feed roller 32 is located upstream of the axial center of the retarding roller 33. To more specific, the axial centers of the feed roller 32 and the retarding roller 33 do not lie on the same perpendicular line, and the axial center of the feed roller 32 is located closer to the first paper cassette 2*a* than the axial center of the retarding roller 33. The first paper feeding mechanism 3*a* thus arranged feeds forward the paper led out from the first paper cassette 2*a* in an upwardly and slightly forward direction, not the horizontal direction.

In the second paper cassette 2*b*, the axial centers of the feed roller 32 and the retarding roller 33 lie on the same perpendicular line.

The paired first and second pull-out rails 4*a* and 4*b* are respectively provided for slidably supporting the first and second paper cassettes 2*a* and 2*b*. Those rail enables the front loading of the first and second paper cassettes 2*a* and 2*b*.

The paired first pull-out rails 4*a* are provided supports both the side wall of the first paper cassette 2*a*, which is located downstream and the bottom surface of the first paper cassette 2*a*. The first paper cassette 2*a* may be supported by one of the side wall rail and the bottom surface rail, if the rail has a strength enough to support the first paper cassette 2*a*, for example, securing about 1500 sheets of paper.

The paired second pull-out rails 4*b*, which is provided in the space present under the second paper cassette 2*b* as the result of the steplike arrangement of the first and second paper cassettes 2*a* and 2*b*, support the bottom surface of the second paper cassette 2*b*.

The paired first and second pull-out rails 4*a* and 4*b* may be designed so as to enable the front loading of the first and second paper feeding mechanisms 3*a* and 3*b* and the first and second paper cassettes 2*a* and 2*b* as well. In the present embodiment, the paired first and second pull-out rails 4*a* and 4*b* enable the front loading of only the first and second paper cassettes 2*a* and 2*b* in order to simplify the first and second paper feeding mechanisms 3*a* and 3*b*. That is, the first and second paper feeding mechanisms 3*a* and 3*b* are fixed to the frame of the copying machine 10.

The paper transport unit 5 is provided above the first paper cassette 2*a*. A paper let out of the second paper cassette 2*b* is substantially horizontally transported to the paper transport path 6, by the paper transport unit 5. The paper transport unit 5 having such a function includes a guide 5*a* for guiding the received paper, and a feed roller 5*b* driven rotationally, by a drive source (not shown), to transport the paper in the guide 5*a*.

When the second paper cassette 2*b* is pulled out, the paper transport unit 5 is pulled out, together with the second paper cassette 2*b*, to the front of the paper feeding device. The paper transport unit 5 further includes a pull-out rail 5*c* and a protruded portion 5*d* to be coupled with the second paper cassette 2*b*. The pull-out rail 5*c* slidably supports the whole paper transport unit 5 while allowing the paper transport unit 5 to be pulled out. The protruded portion 5*d* is coupled with a protruded portion 8*a* protruded from the downstream side wall of the second paper cassette 2*b*, by means of proper coupling means 8*b*, such as screws or pins.

The paper transport path 6 is used for transporting a paper delivered from the first paper cassette 2*a* and the paper transport unit 5, to the image forming unit 14 located in the upside of the paper feeding device 1. The paper transport path 6 includes inclined guides 6*a* and 6*b* having curved guide surfaces which each change a substantially horizontal paper transporting direction to a substantially vertical paper transporting direction. Each of the inclined guides 6*a* and 6*b* receives a paper, which is substantially horizontally delivered from the first paper cassette 2*a* or the paper transport unit 5, and guides and transports the paper in the substantially vertical direction. The paper transport path 6 includes guide 6*c* for guiding the paper which the transporting direction is changed to the substantially vertical direction, to the image forming unit 14, and a feed roller 6*d* driven rotationally by a drive source (not shown), to transport the paper in the paper transport path 6.

A case where papers are transported into the image forming unit 14 in the paper feeding device 1 thus constructed will be described.

Papers are supplied to and stored into the first and second paper cassettes 2*a* and 2*b* in the paper feeding device 1 before the papers are transported into the image forming unit 14. To supply papers to the first and second paper cassettes 2*a* and 2*b*, those cassettes are pulled out of the paper feeding device to the front of the machine. The paper cassettes are manually pulled out by a user. Normally, the first and second paper cassettes 2*a* and 2*b* are separately pulled out. In other words, during the feeding of papers from one of the cassettes to the copying machine, the other cassette may be pulled out for supplying papers to the cassette.

Figure 3A:
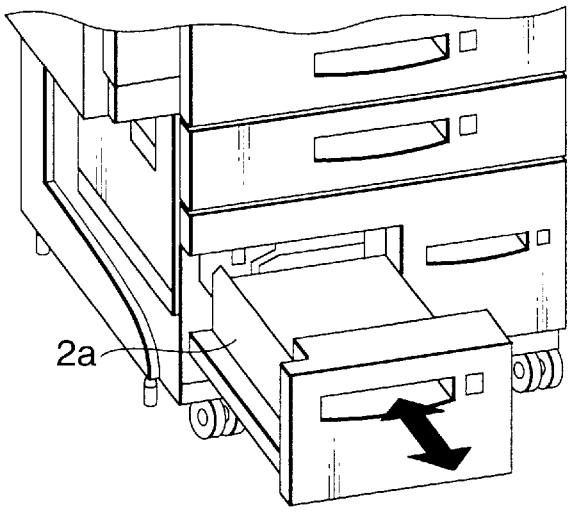
FIG. 3A shows the paper supplying to the first paper cassette.

To supply papers to the first paper cassette 2*a*, for example, only the first paper cassette 2*a* is pulled out of the paper feeding device as shown in FIG. 3A. At this time, the second paper cassette 2*b* is not pulled out, and hence it can feed papers to the image forming unit 14, through the paper transport unit 5 and the paper transport path 6.

After the paper supply to the first paper cassette 2*a* is completed, the first paper cassette 2*a* is returned into the paper feeding device 1. Then, the first paper feeding mechanism 3*a* feeds papers sheet by sheet from the first paper cassette 2*a*, and the papers is transported to the image forming unit 14 through the paper transport path 6.

Figure 3B:
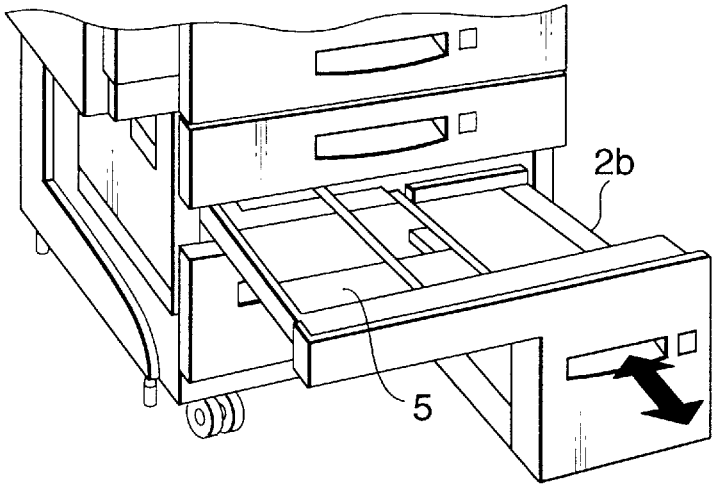
FIG. 3B shows the paper supplying to the second paper cassette.

To supply papers into the second paper cassette 2*b*, only the second paper cassette 2*b* is pulled out as shown in FIG. 3B. At this time, the first paper cassette 2*a* is not pulled out. Therefore, as in the above case, papers may be fed from the second paper cassette 2*b* to the image forming unit 14 through the paper transport path 6. The second paper cassette 2*b* is coupled with the paper transport unit 5 by means of coupling means 8*b*. Therefore, when the second paper cassette 2*b* is pulled out, the paper transport unit 5 is also pulled out.

Figure 3C:
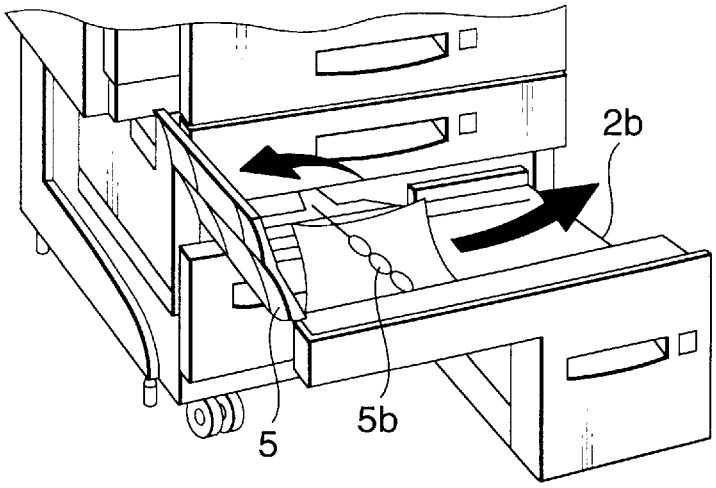
FIG. 3C shows the removal of paper jam from a paper transport unit in the paper feeding device.

When the second paper cassette 2*b* is pulled out, the user can do the paper supplying work to the second paper cassette 2*b*, and further, as shown in FIG. 3C, removal of jamming and maintenance work for the feed roller 5*b* in the paper transport unit 5. If the second paper cassette 2*b* is constructed to decouple from the paper transport unit 5, only the second paper cassette 2*b* is pulled out while leaving the paper transport unit 5 in the paper feeding device 1.

After the paper supply to the second paper cassette 2*b* is completed, the second paper cassette 2*b* is returned into the paper feeding device 1. Then, the second paper feeding mechanism 3*b* feeds papers sheet by sheet from the second paper cassette 2*b* to the paper transport unit 5, and then transports the papers to the paper transport path 6 and finally to the image forming unit 14.

Papers are supplied to the first and second paper cassettes 2*a* and 2*b* every paper cassette. The papers of the same or different sizes may be put in those cassettes.

The paper supplying from the first and second paper cassettes 2*a* and 2*b* to the image forming unit 14 is also performed every paper cassette. In a case where the papers of the same size are put in the first and second paper cassettes 2*a* and 2*b*, the paper feeding from the first paper cassette 2*a* is completed and then the paper feeding from the second paper cassette 2*b* starts (or the paper feeding from the first paper cassette 2*a* follows that from the second paper cassette 2*b*). In a case where papers of different sizes are put in those cassettes and the papers of specific size are used in the image forming unit 14, the cassette containing the papers of the requested size is specified and those papers are fed from the specified cassette.

As described above, in the paper feeding device 1 of the embodiment, the feed and retarding rollers 32 and 33 of the second paper feeding mechanism 3*b* are positioned above the upper end of the first paper cassette 2*a*, that is, the feed and retarding roller 32 and 33 of the second paper feeding mechanism 3*b* overhangs the upper end of the first paper cassette 2*a*.

For this reason, although the feed and retarding rollers 32 and 33 of the second paper feeding mechanism 3*b* are located downstream of the downstream end of the second paper cassette 2*b*, there is no need of providing a space for receiving those rollers 32 and 33 between the first and second paper cassettes 2*a* and 2*b*.

In the paper feeding device of the invention, the space, which is present between the first and second paper cassettes 2*a* and 2*b* being juxtaposed, is more reduced than that in the conventional paper feeding device. Further, there is no need of simplifying the second paper feeding mechanism 3*b*. The paper feeding device 1 enables the paper supplying from the first and second paper cassettes 2*a* and 2*b* to be done independently, whereby realizing the further space saving.

The structure that the feed roller 32 and the retarding roller 33 of the second paper feeding mechanism are disposed so as to overhang the upper end of the first paper cassette 2*a*, is very useful for the space saving of the paper feeding device 1. The reason for this is that the space used for receiving the feed roll 32 and the retard roll 33 is larger than the space used for other components (e.g., pull-out rails).

In the paper feeding device 1, the paired first pull-out rails 4*a* are provided the downstream side wall of the first paper cassette 2*a* and the bottom surface of the first paper cassette 2*a*. The paired second pull-out rail 4*b* are provided in the bottom surface of the second paper cassette 2*b*. With this structure of the paper feeding device, there is no need of forming a space for receiving the paired first pull-out rails 4*a* or the paired second pull-out rails 4*b* between the first and second paper cassettes 2*a* and 2*b*. This feature also contributes to the space saving.

With provision of the first and second pull-out rail pairs 4*a* and 4*b*, it is possible to independently pull out the first and second paper cassettes 2*a* and 2*b*, whereby supplying papers from one of the first and second paper cassettes 2*a* and 2*b*. In the conventional paper feeding device, the image forming processing by the image forming unit 14 must be interrupted in order to supply papers to one of the first and second paper cassettes 2*a* and 2*b*. However, when the paper feeding device 1 of the invention is used, the user may supply papers to one of the first and second paper cassettes 2*a* and 2*b* without interrupting the image forming processing by the image forming unit 14, whereby being free from reduction of the image forming processing efficiency.

The first and second paper cassettes 2*a* and 2*b* are steplike arranged such that the second paper cassette 2*b* is higher than the first paper cassette 2*a*. This steplike arrangement of those cassettes allows the combination of the feed roller 32 and the retarding roller 33 to be disposed so as to overhang the upper end of the first paper cassette 2*a*. The result is to realize the space saving of the copying machine. Further, the steplike arrangement produces a space under the second paper cassette 2*b* and eliminates a superfluous space upper the second paper cassette 2*b*. The produced space may be used for placing second pull-out rail pair 4*b* and the drive mechanism for the lifter 7 therein. Thus, the steplike arrangement realize an efficient use of the limited space within the paper feeding device.

In the first paper feeding mechanism 3*a*, the axial centers of the feed roller 32 and the retarding roller 33 do not line on the same perpendicular line, that is, the axial center of the feed roller 32 is located closer to the first paper cassette 2*a* than the axial center of the retarding roller 33. The first paper feeding mechanism 3*a* thus arranged feeds the paper let out of the first paper cassette 2*a* in an upwardly and slightly forward direction, not the horizontal direction. The result is to reduce the space for receiving the inclined guide 6*a* of the paper transport path 6, that is, the space for changing the transporting direction of the paper delivered from the first paper feeding mechanism 3*a*. Therefore, the paper transport path 6 may be located close to the first paper cassette 2*a*, leading to a further space saving.

Thus, the paper feeding device 1 of the embodiment more saves the inner space thereof than the conventional one. In the copying machine 10 having the paper feeding device 1 incorporated thereinto, the machine size and hence an area occupied by the machine are reduced. Sine the machine size is reduced without reducing the number of cassette contained papers, the copying machine with the paper feeding device is able to successively copy a great number of papers (for example, 1500 sheets×2).

It is evident that the invention may be applied to three or more number of juxtaposed paper cassettes, while the above-mentioned embodiment is applied to two juxtaposed paper cassettes, such as the first and second paper cassettes 2*a* and 2*b* within the paper feeding device 1.

Figure 4:
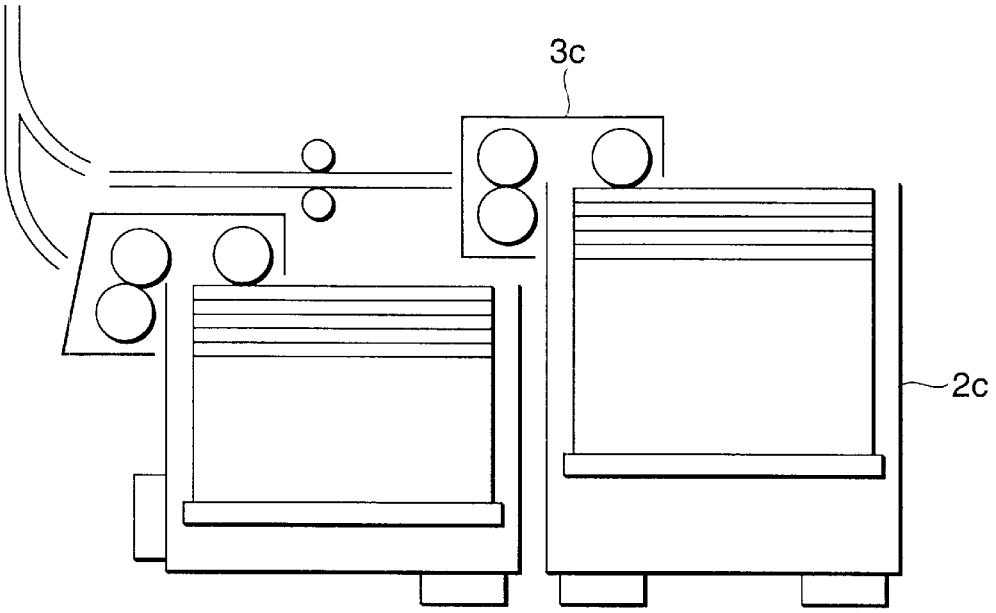
FIG. 4 is a diagram showing a key portion of another embodiment of the present invention.
Figure 5:
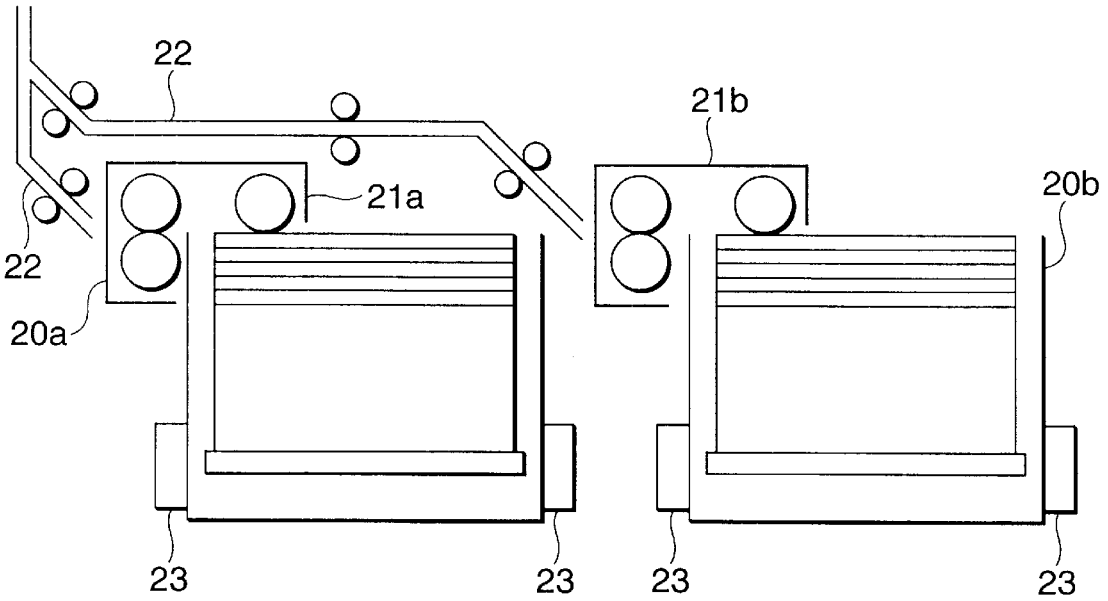
FIG. 5 is a diagram showing a key portion of a conventional paper feeding device.

In the above-mentioned embodiment, the first and second paper cassettes 2*a* and 2*b* having the same paper containing capacity are steplike arranged, whereby the second paper feeding mechanism 3*b* overhangs the upper end of the first paper cassette 2*a*. If the first and second paper cassettes 2*a* and 2*b* are steplike arranged so that the position at which the second paper cassette 2*b* supplies papers, viz., the paper supplying position of the second paper cassette 2*b*, is higher than that of the first paper cassette 2*a*, the second paper feeding mechanism 3*b* can be disposed so as to overhang the upper end of the first paper cassette 2*a*. In this case, even if the paper containing capacities of the first and second paper cassettes 2*a* and 2*b* are different, the space saving effect mentioned above is secured. The present invention is applicable to a paper feeding device as shown in FIG. 4 in which the paper containing capacity of the upstream paper cassette 2*c* is increased to realize the overhang arrangement of the paper feeding mechanism 3*c*. This paper feeding device realizes the increase of the number of papers contained in the paper cassette, in addition to the space saving.

In the above-mentioned embodiment, although the invention is applied to the paper feeding device 1 incorporated into the copying machine 10, the invention is applicable to the paper feeding device for a printer, facsimile machine or the like if the device is of the type in which a plural number of paper cassettes are substantially horizontally juxtaposed.

[Effects of the Invention]

In the paper feeding device of the invention, separation/feeding means of a paper feeding mechanism corresponding to an upstream paper cassette is positioned above a downstream paper cassette. The space between the juxtaposed paper cassettes is smaller than that in the conventional paper feeding device. The result is to provide a compact paper feeding device.

The paper feeding device enables the paper cassettes to independently supply papers while achieving more space savings.

What is claimed is:

1. A paper feeding device for feeding papers to an image forming unit in an image forming apparatus, said paper feeding device comprising:

a plurality of paper cassettes each having a paper receiving section that contains papers, said paper cassettes being substantially horizontally juxtaposed, a plurality of paper feeding mechanisms respectively corresponding to said paper cassettes, each of said paper feeding mechanisms including separation/feeding means for feeding papers from said paper cassette in a feeding direction which is substantially horizontal, said feeding direction defining a downstream side and an upstream side, said separation/feeding means including a separation roller and associated roller pair having at least one feed roller and at least one retard roller protruded in the downstream side of said paper cassette, wherein, in said paper cassettes being adjacent to each other, said separation/feeding means corresponding to an upstream paper cassette of the upstream side is arranged at least partially above the paper receiving section of a downstream paper cassette of the downstream side.

2. A paper feeding device according to claim 1, further comprising:

pull-out means for pulling out said paper cassette forwardly so as to supply papers, wherein said pull-out means of said upstream paper cassette is mounted on the bottom surface thereof and said pull-out means of a most downstream paper cassette provided in most downstream side of said plurality of paper cassettes is mounted on at least one of a downstream side wall of said most downstream paper cassette and a bottom surface thereof.

3. A paper feeding device according to claim 1, wherein said paper cassettes, located adjacent to each other and having equal paper containing capacities, are steplike arranged in the feeding direction such that said upstream paper cassette is arranged above said downstream paper cassette.

4. A paper feeding device according to claim 1, wherein said paper cassettes located adjacent to each other, are steplike arranged in the feeding direction such that a first paper feeding position of said upstream paper cassette is higher than a second paper feeding position of said downstream paper cassette.

5. A paper feeding device according to claim 1, wherein said feed roller is turned in the feeding direction, and said retarding roller is located under said feed roller, said retarding roller receiving at least one of a rotary torque opposite in a rotational direction of said feed roller and a stopping torque, and further wherein, in said separation/feeding means of a most downstream paper cassette provided in most downstream side of said paper cassettes, the axial center of said feed roller is located closer to the paper cassette with respect to the feeding direction than the axial center of said retarding roller.

6. A paper feeding device according to any of claim 1, wherein said upstream paper cassette having a paper transport unit for transporting papers in the feeding direction, said paper transport unit provided above said downstream paper cassette, and further wherein said paper transport unit is forwardly pulled out together with said upstream paper cassette, when said upstream paper cassette is pulled out.

* * * * *